US005937602A

United States Patent [19]

Jalbert

[11] Patent Number: 5,937,602

[45] Date of Patent: Aug. 17, 1999

[54] GROUND COVER WITH IMPROVED RESISTANCE TO DEGRADATION BY FREEZING AND THAWING

[76] Inventor: Gaetan Jalbert, 1026, rue Racine, Valcourt, Canada, J0E 2L0

[21] Appl. No.: 09/040,333

[22] Filed: Mar. 18, 1998

[30] Foreign Application Priority Data

Mar. 19, 1997 [CA] Canada ..... 2200484

[51] Int. Cl.[6] ..... E04F 15/14

[52] U.S. Cl. ..... 52/318; 404/37

[58] Field of Search ..... 52/318, 414; 404/18, 404/37

[56] References Cited

U.S. PATENT DOCUMENTS

| | | | |
|---|---|---|---|
| 163,506 | 5/1875 | Mock | 52/318 |
| 1,505,642 | 8/1924 | Henry | 52/318 |
| 1,539,988 | 6/1925 | Bowman | 52/318 |
| 1,841,819 | 1/1932 | Kellett | 404/37 |
| 2,867,886 | 1/1959 | Benson | 249/4 |
| 3,148,482 | 9/1964 | Neale | 50/343 |
| 3,344,570 | 10/1967 | Marson | 52/318 |
| 3,562,993 | 2/1971 | Humble et al. | 52/318 |
| 3,956,864 | 5/1976 | Fung | 52/414 |
| 4,566,240 | 1/1986 | Schilger | 52/414 |
| 4,932,182 | 6/1990 | Thomasson | 52/318 |
| 5,406,763 | 4/1995 | Al-Saleh | 52/311.1 |
| 5,615,971 | 4/1997 | Boevé | 404/37 |
| 5,636,485 | 6/1997 | Al-Saleh | 52/311.1 |

*Primary Examiner*—Beth A. Aubrey
*Attorney, Agent, or Firm*—Robic

[57] ABSTRACT

A ground cover with an improved resistance to degradation by freezing and thawing, a kit for the manufacture of the ground cover and a method for manufacturing such a ground cover. The ground cover has a plurality of molds each having a bottom wall and side walls. The molds have their bottom walls laying flat onto the ground and are positioned with their side walls in close adjacent relationship with respect to each other so as to fully cover the ground. Connectors of given flexibility extend through the side walls of pairs of adjacent molds in order to connect the molds to each other. A filling material is poured and hardened into said molds. The filling material acts as a covering. Once installed, the ground cover forms a network that can easily be adapted to floor surfaces of different shapes. The cover is prepared by attaching together similar units made from a kit consisting of the molds and the connectors of given flexibility. Of course, the number of elements in the kit is proportional to the surface to be treated. When connected together, the molds can receive the filling material which is preferably concrete. When cured and hardened, the filling material, together with the flexible connectors and the molds, provide the cover with a high resistance to degradation due to freezing or to thawing, thereby making them suitable for countries like Canada or the northern part of the United States.

15 Claims, 4 Drawing Sheets

GROUND COVER WITH IMPROVED RESISTANCE TO DEGRADATION BY FREEZING AND THAWING

BACKGROUND OF THE INVENTION

1. Field of the Invention

The invention relates to a ground cover with improved resistance to degradation by freezing and thawing and/or to degradation by any other natural movings of the ground, to a kit for the manufacture of this ground cover and to the method for manufacturing such a ground cover.

2. Brief Description of the Prior Art

A number of different devices and methods currently exist for making material makeup placed over and onto existing floor surfaces, as means of enhancing the look and wearability of both indoor and outdoor surfaces.

Devices for making paving with sophisticated ornamental forms are disclosed in U.S. Pat. No. 2,867,886. Such devices consist of molds which are removed when the concrete is dry.

In another conventional method, large surfaces to be treated are covered with a single concrete plate and an ornamental effect is obtained with molds which are placed on the surface of the humid concrete and which are removed when the concrete is dry. Such a method is described in U.S. Pat. No. 5,406,763.

Floor surfaces adapted to heavy traffic are described in U.S. Pat. No. 1,841,819, in U.S. Pat. No. 3,148,482, in U.S. Pat. No. 3,344,570 and in U.S. Pat. No. 4,932,182. The expected result is obtained by addition of a reinforcing rigid framework. An alternative solution is proposed in U.S. Pat. No. 1,539,988 with the device constituted of moulded elements wherein the elements are simultaneously rigidly anchored on a rigid support and wherein each block is flexiblely anchored to every adjacent block.

U.S. Pat. No. 5,615,971 shows ground covering elements consisting of a plurality of components with an elastic link between the components. Such a ground covering element is prepared in the factory and has to be transported and installed onto the ground to be covered with the inherent risk that such element be damaged during transportation or installation.

None of the known methods or devices provides ground covering elements which are suitable for countries like Canada or the northern part of the United States wherein extreme freezing and thawing forces apply to such protective and decorative covers or for places like California wherein earthquakes frequently occur.

As can be appreciated, a ground cover which is placed outdoor in a country like those mentioned above is submitted to extreme forces generated by the repetitive freezing and thawing of the natural supporting material. This phenomena results first in the optical degradation of the surface of the cover. Then, cracks appear as a first sign of degradation of the internal structure. After appearance of the cracks, the degradation of the cover accelerates and splitting of the cover may even occur. Even with known sophisticated methods and apparatus, such as covers with a reinforced rigid metallic structure, the degradation ineluctably takes place in a relatively short period of time after the cover has been installed onto the surface to be covered.

A similar degradation phenomena is generated by other significant natural movings of the ground, like those generated by earthquakes.

OBJECT AND SUMMARY OF THE INVENTION

The objects of the invention is to overcome the disadvantages of the presently available methods and apparatus for making protective and decorative covers.

More particularly, a first object of the present invention is to provide a ground cover that can be used as a protective and decorative ground covering and has an improved resistance to degradation caused by freezing and thawing or caused by any other natural motion of the ground.

The ground cover according to the invention comprises:

- a plurality of molds each having a bottom wall and side walls, the molds having their bottom walls laying flat onto the ground and being positioned with their side walls in close adjacent relationship with respect to each other so as to fully cover said ground;
- connectors of given flexibility extending through the side walls of pairs of adjacent molds in order to connect said molds to each other; and
- a filling material poured and hardened into the molds, said filling material acting as a covering.

More particularly, the ground cover comprises:

- a plurality of molds disposed side by side on the ground, each mold having a bottom wall laying flat on the ground and side walls, each side wall of a mold forming a pair of adjacent side walls with a side wall of an adjacent mold;
- a plurality of flexible connectors each connecting a corresponding pair of adjacent side walls; and
- a filling material poured and hardened into said molds, said filling material acting as a covering.

Preferably, the connectors of given flexibility extend through the side walls of every pair of adjacent molds.

Once installed, the ground cover according to the invention is in the form of a network of molds filled up with the hardened material. It can easily be adapted to floor surfaces of a variety of shapes. The cover is prepared by attaching together similar units made from a kit consisting of molds and of connectors of given flexibility. Of course, the number of elements in the kit is proportional to the surface to be treated. When connected together, the molds can receive a filling material that can be selected from a variety of filling compositions. When cured and hardened, the filling material, together with the flexible connectors and the molds, provide the cover with a high resistance to degradation due to freezing, thawing or any other natural motion of the ground. This improved resistance to degradation can be explained by the fact that the cover according to the invention is constituted of a plurality of units that are connected together but each has the ability to slightly move up and down with respect to the adjacent units.

The use of the molds with the specific form according to the invention results in a significant decrease of the amount of filling material which is necessary to cover the surface to be treated; in comparison with traditional concrete plates, about 20% of concrete is saved.

Because numerous filling compositions can be used in the preparation of the permanent molds of the invention and the filling of the molds is only done after the network is placed on the complete surface to be treated, complex forms can be easily prepared in situ and therefore transportation of bulky and heavy devices is avoided.

A second object of the invention is to provide a kit of manufacturing the above mentioned ground cover. The kit according to the invention comprises:

- molds each having a bottom wall and side walls, the molds being devised to be laid flat onto the ground to be covered, the side walls of each mold being shaped so as to be positionable in close adjacent relationship with respect to the side walls of the other molds; and
- connectors of given flexibility intended to be inserted through the side walls of pairs of adjacent molds in order to connect said molds to each other.

The structural elements forming the kit can be easily manufactured, stored and transported on the site. Due to the relatively light weight of the material used for the manufacture of the elements of the kit and due to the fact that these elements of the kit can be packed in a compact form, the freight costs for transportation are significantly reduced.

A third object of the invention is to provide a method for manufacturing a ground cover as disclosed hereinabove. The method according to the invention comprises the steps of:

positioning onto the ground a plurality of molds each having a bottom wall and side walls, said molds having their bottom walls laying flat onto the ground and being positioned with their side walls in close adjacent relationship with respect to each other so as to fully cover said ground;

connecting pairs of adjacent molds by inserting connectors of given flexibility through the side walls of adjacent molds;

pouring the filling material into the molds; and letting the filling material harden.

With this method, a network of units may be assembled at the site where the protective surface is to be made. A specialized technician is not required to assemble the network and apply the filling material to complete the protective and decorative cover. Thus, the present invention reduces the amount of time required to make a high quality cover. Finally, a significant reduction of the costs of making protective and decorative cover is reached.

BRIEF DESCRIPTION OF THE DRAWINGS

In order that the manner of achieving the above recited features and advantages of the present invention be better understood, a more detailed description of the invention will now be made with reference to a plurality of preferred embodiments thereof illustrated in the appended drawings. It is to be noted that the appended drawings illustrate only typical embodiments of this invention and are therefore not to be considered as limiting of its scope, since the invention may admit other equally effective embodiments.

DETAILED DESCRIPTION OF THE PREFERRED EMBODIMENT

Figure 1:
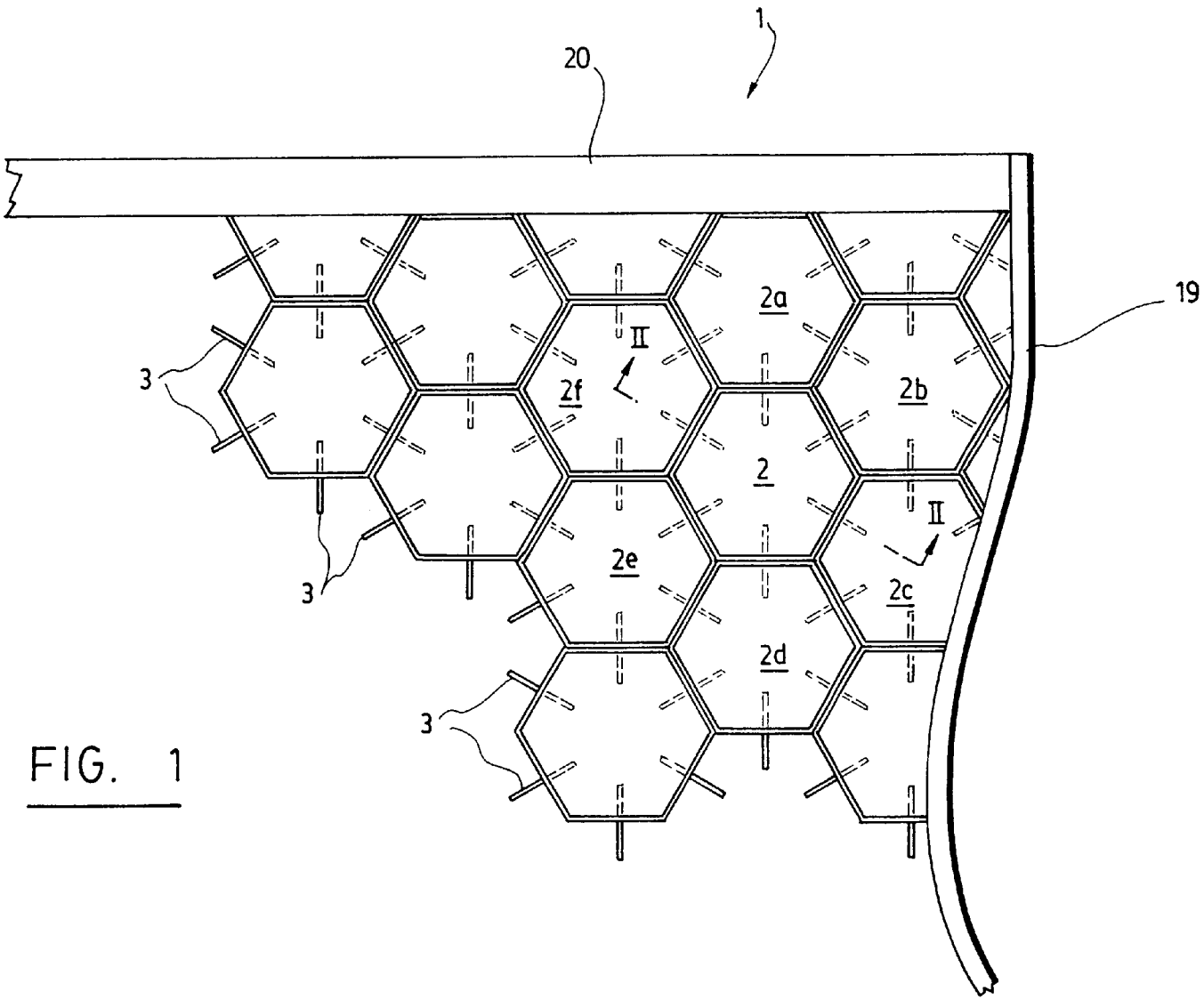
FIG. 1 is a top plan view illustrating a ground cover according to a first preferred embodiment of the invention wherein hexagonal units are formed and shown in a solid outline form.
Figure 3:
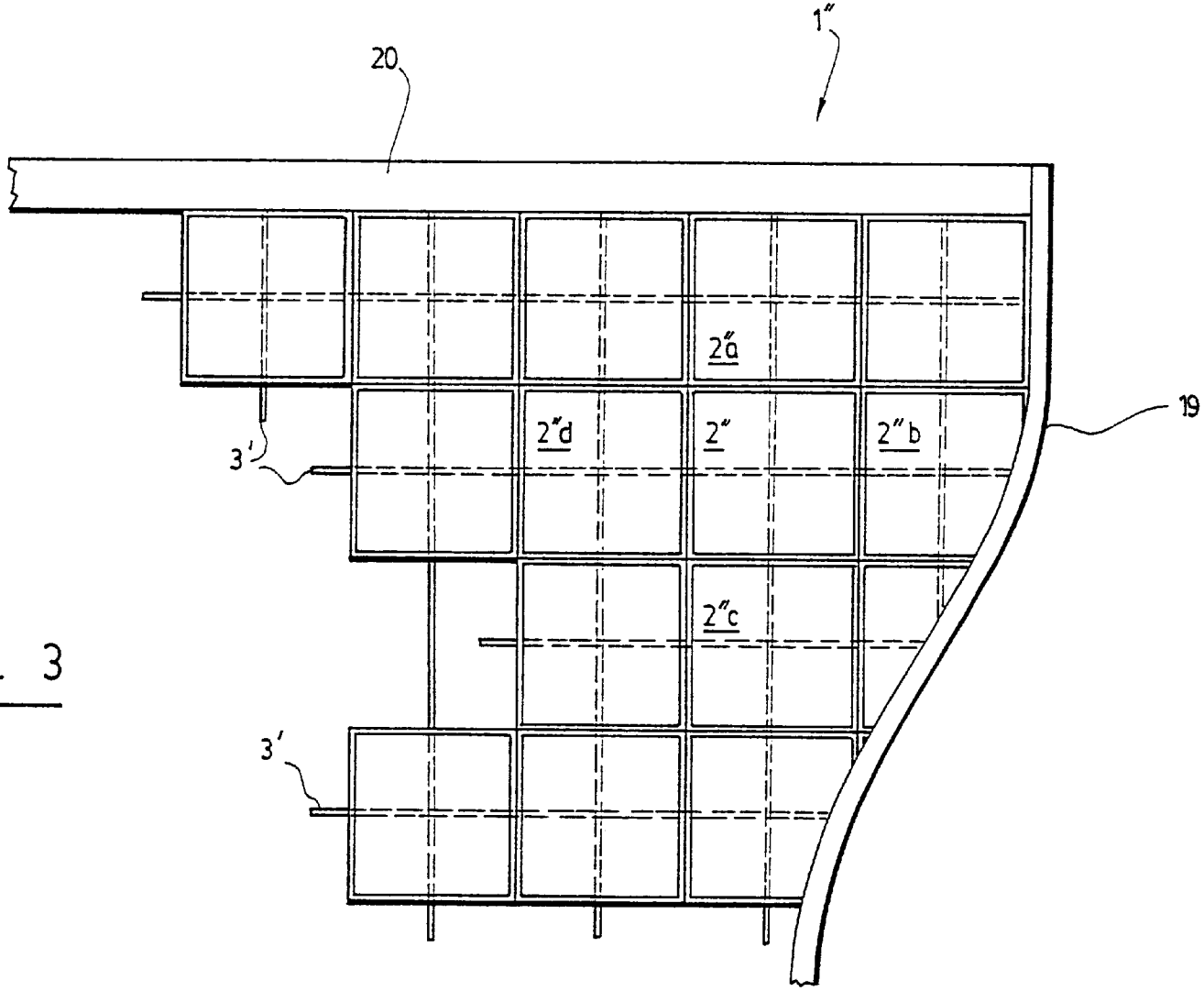
FIG. 3 is a top plan view illustrating a ground cover according to a second preferred embodiment of the invention wherein quadratic units are formed and shown in a solid outline form.
Figure 4:
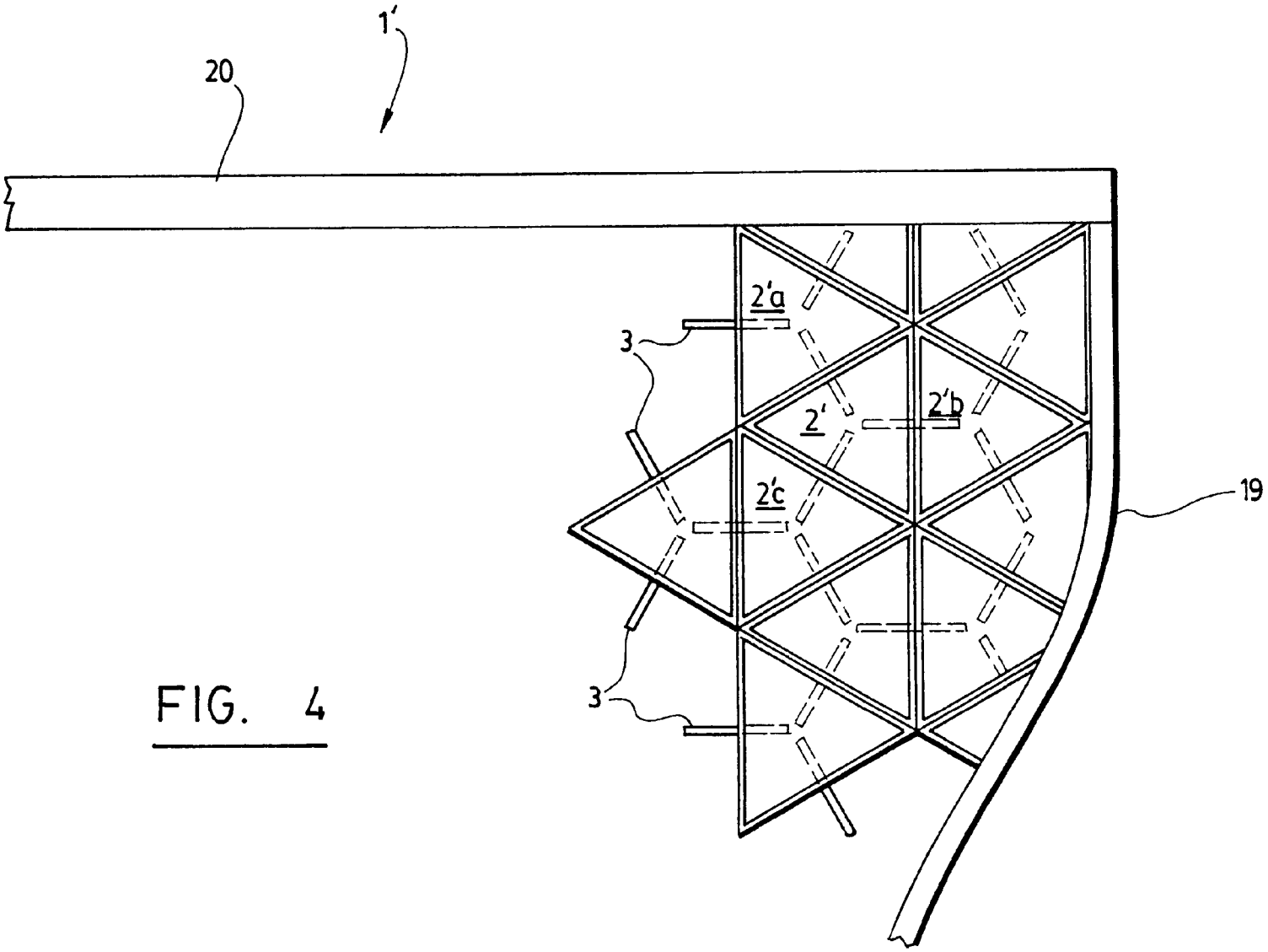
FIG. 4 is a top plan view illustrating a ground cover according to a third preferred embodiment of the invention wherein triangular units are formed and shown in a solid outline form.

As shown in FIGS. 1, 3 and 4, the ground cover 1, 1', 1" according to the invention is made of units 2, 2' and 2" respectively in the form of an hexagon, a triangle and a square.

Figure 2:
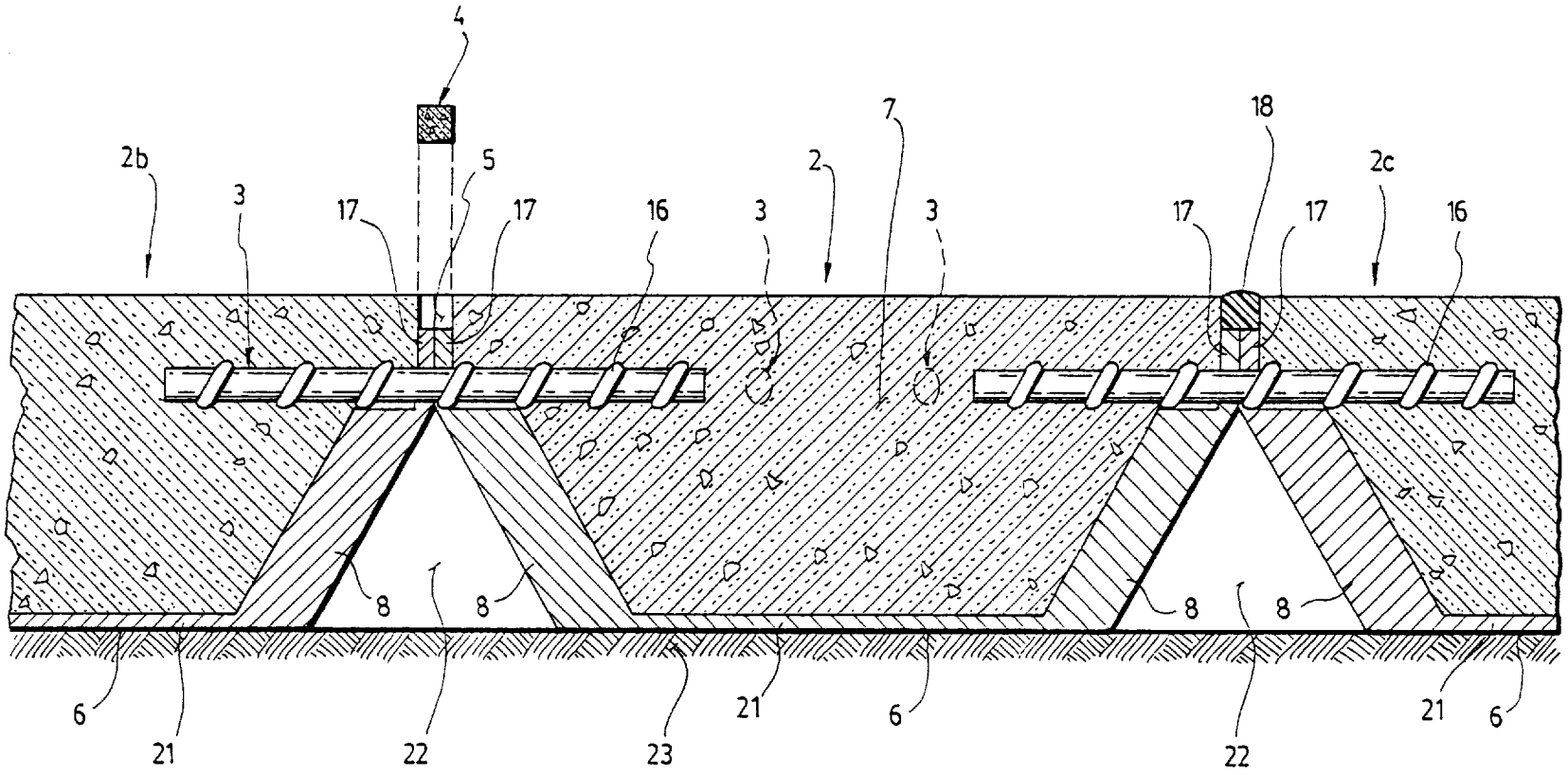
FIG. 2 is a cross-sectional view taken along line II—II of FIG. 1.

The unit 2 with an hexagonal form is shown in greater details in FIG. 2. It comprises a mold 6 having a bottom wall 21 and side walls 8 which lay flat onto the ground 9. The side wall of the mold is positioned in close relationship with respect to the side walls of the molds of units 2*a*, 2*b*, 2*c*, 2*d*, 2*e* and 2*f*.

The molds 6 have bevelled edges at the bottom of their side walls 8 all around their bottom walls 21. The bevelled bottom edges together with the ground surface 23 create an empty space 22, free of any filling material. The empty space 22 is responsible for the saving of filling material. The molds 6 are made of a material of a given rigidity. This material is preferably selected from the group consisting of rigid foams, plastic materials, cardboard or any other biodegradable material. Most preferably, the molds 6 are made of polystyrene.

Connectors 3 of given flexibility extend through the side walls of pairs of adjacent molds 6. Preferably, these connectors 6 consist of rods made of a material with a given flexibility. They can be made of steel or a pultruted plastic material. When the molds are filled with concrete 7 or with a similar filling material, the connectors 3 are embedded in part of the filling material 7 and are provided. To facilitate their anchoring into the concrete, anchoring corrugations 16 can be provided. Preferably, and as shown, the connectors 3 extend through the side walls of every pair of adjacent molds and connect said molds to each other. In such a case, the number of connectors present in the cover 1 with a hexagonal shape is 3 times the number of molds.

More generally, the number of connectors 6 present in the ground cover 1 is proportional to the surface to be covered and is about an half of the number of side walls of the geometric form created by the upper surface of the adjacent molds. The number of connectors can also be calculated by counting one connector for every pair of adjacent molds. A mold of a hexagonal shape like the one shown in FIG. 1 is crossed by 6 connectors.

As aforesaid, each mold 6 is filled up with a filling material after it has been installed. Such a filling material preferably consists of concrete or a cement-based grout including or not including pigments. After the filling material has hardened, the upper edges of the cover are trimmed. In a preferred embodiment of the invention, a protective sealant is applied onto the filling material 7 and onto the trimmed upper edges 17 of the molds 6. The grooves 5 resulting from the trimming 4 can be filled with a protective and decorative elastic joint 18 in contact with the filling material and the trimmed upper edges 17 of the molds 6. The grooves 5 can also be let free.

To install a ground cover 1 according to the present invention as disclosed hereinabove, a plurality of molds 6 each having a bottom wall 21 and side walls 8, are positioned onto the ground . The ground is advantageously cleaned and leveled in a preparatory step. The bottom walls 21 are laid flat onto the ground and they are positioned with their side walls 8 in close adjacent relationship with respect to each other so as to substantially cover the ground. The surface to be covered is limited by a preexisting obstacle 20 such as a wall or by an added curb 19 of any desired form and length. When necessary, the molds placed along the curb or along the natural obstacle are adjusted to the limiting borders. Then, some or preferably all adjacent molds 6 are connected by inserting the flexible connectors 3 through their side walls 8. The filling material 7 is poured into the molds 6 and the filling material is let harden. Then, preferably after a first hardening period and before the complete hardening of the filling material occurs, the upper edges of adjacent walls are trimmed so as to give the desired relief to the ground cover. The size of the grooves corresponds to the thickness of the upper edge 17 two adjacent walls of the molds. The depth of the grooves is not critical provided the connectors remain fully protected by the filling material 7 and by the upper edges 17. Values of about 0.3 inch are generally suited. The so obtained ground cover can finally be cleaned and treated with a sealant. Preferably, the scellant is of the acrylic type and is applied twice. The grooves 5 which result from the trimming of the upper edges of the molds may be filled with a material 18 such as a silicone, which conserves a given elasticity after drying.

As shown in FIG. 4, the units 2' of the ground cover 1' may be in the form of a triangle. In such a case, each unit 2' is adjacent to three similar triangular units 2'*a,* 2'*b* and 2'*c* and three connectors extend through the side walls of each pair of adjacent molds.

FIG. 3 illustrates another embodiment of the invention wherein the units 2" of the ground cover 1" are in the form of a square. Each unit 2' is adjacent to four similar quadratic units 2"*a,* 2"*b,* 2"*c* and 2"*d.* Instead of having separate connectors, a single connector 3' extends through the side walls of all adjacent molds belonging to a same row. As can be appreciated, the same techniques could also be used to connect hexagonal units 2.

In a commercial form, a kit can be provided for the manufacture of the ground cover represented in FIGS. 1 and 4. This kit comprises molds 6 and connectors 3. In the case wherein a connector has a length which limits its use to the connection of two adjacent side walls, then the number of connectors 3 in the kit is about half the number of side walls 8 of the molds which are adjacent to each other when the kit is assembled in the form of a network. As an example, in the case of molds of hexagonal forms as represented in FIGS. 1 and 2, this number of "short" connectors is 3 per mold. In the case of quadratic molds and for the cover represented in FIG. 3, the number of connectors is of 2 per mold. For the specific cover represented in FIG. 3, the total number of connectors to be present in the kit is of 9. In the case of triangular molds as represented in FIG. 4, the ratio of connectors per mold is 1,5.

However, in the case wherein the connector goes through all the parallel side walls of the molds aligned in rows, then the number of connectors 3' is proportional to the number of rows.

While the invention herein is described in what is presently considered to be a practical preferred embodiment thereof, it will be apparent that many modifications may be made within the scope of the invention, which scope is to be accorded the broadest interpretation of the appended claims so as to encompass all equivalent covers, methods and kits.

I claim:

1. A ground cover comprising:

a plurality of molds disposed side by side on the ground, each mold having a bottom wall laying flat on the ground and side walls, each side wall of one of said molds forming a pair of adjacent side walls with one of said walls of one of the adjacent molds;

a plurality of flexible connectors each connecting one of said pairs of adjacent side walls; and a filling material poured and hardened into said molds, said filling material acting as a covering.

2. The ground cover of claim 1, wherein:

each of said molds is made of a material selected from the group consisting of rigid foams, plastic materials and cardboard;

each of said connectors comprises a rod made of steel or pultruded plastic material, each rod extending transversely through one of said pairs of adjacent side walls and having end portions embedded into the filling material; and said filling material consists of concrete or cement-based grout.

3. The ground cover of claim 2, wherein:

each of said molds has a polygonal shape selected from the group consisting of triangular, square, rectangular, pentagonal, hexagonal and octagonal shapes; and said sidewalls of each mold are outwardly bevelled.

4. The ground cover of claim 3, wherein:

said connectors are provided with anchoring corrugations.

5. The ground cover of claim 4, wherein each sidewall of said pairs of adjacent sidewalls has an upper edge recessed with respect to an upper surface of said filling material thereby giving a relief to said ground cover.

6. The ground cover of claim 5, wherein:

said molds are made of polystyrene and are hexagonal in shape; and said rods are made of pultruded plastic material.

7. A kit for manufacturing a ground cover, said kit comprising:

a plurality of molds each having a bottom wall to lay flat on the ground to be covered and side walls, the side walls of each mold being shaped so as to be positionable in close adjacent relationship with respect to the side walls of the other molds to form pairs of adjacent sidewalls;

a plurality of flexible connectors each intended to be inserted through the side walls of one of said pairs of adjacent sidewalls to connect the molds together; and a filling material to be poured and hardened into said molds for acting as a covering.

8. The kit of claim 7, wherein:

said molds are made of a material selected from the group consisting of rigid foams, plastic materials and cardboard;

said connectors consist of rods made of steel or pultruded plastic material, said rods are adapted to extend transversely through said pairs of adjacent side walls and have end portions adapted to be embedded into the filling material and said filling material consists of concrete or cement-based grout.

9. The kit of claim 8, wherein:

each of said molds have a polygonal shape selected from the group consisting of triangular, square, rectangular, pentagonal, hexagonal and octagonal shapes; and said sidewalls of each mold are outwardly bevelled.

10. The kit of claim 9, wherein:

said connectors are provided with anchoring corrugations.

11. The kit of claim 10, wherein:

said molds are made of polystyrene and are hexagonal in shape; and said rods are made of pultruded plastic material.

12. A method for manufacturing a ground cover, comprising the steps of:

disposing side by side on the ground a plurality of molds each having a bottom wall laying flat on the ground and side walls, said molds being disposed such that each of said side walls of one of said molds forms a pair of adjacent side walls with one of said side walls of one of the adjacent molds so as to fully cover said ground;

connecting each of said pairs of adjacent sidewalls by inserting a flexible connector through said adjacent sidewalls;

pouring a filling material into said molds; and letting said filling material harden.

13. The method of claim 12, wherein each sidewall of said pairs of adjacent sidewalls has an upper edge and wherein said method comprises the additional step of:

trimming each of said upper edges after the filling material has hardened so as to give a relief to said ground cover.

14. The method of claim 13, further comprising a step of:

filling a grooved volume resulting from the trimming with a protective or decorative elastic joint.

15. The method of claim 14, comprising the additional steps of:

bordering said ground with a border prior to said disposing of said molds on the ground.

* * * * *